US005474481A

United States Patent [19]

Ramsey

[11] Patent Number: 5,474,481

[45] Date of Patent: Dec. 12, 1995

[54] MULTI-SPORT FLOTATION SYSTEM

[76] Inventor: James W. Ramsey, 2870 St. Michael Dr., Missoula, Mont. 59803

[21] Appl. No.: 219,641

[22] Filed: Mar. 28, 1994

Related U.S. Application Data

[63] Continuation-in-part of Ser. No. 861,750, Apr. 1, 1992, Pat. No. 5,297,978.

[51] Int. Cl.[6] ..... B63C 9/08

[52] U.S. Cl. ..... 441/131; 114/345; 114/346; 441/40; 441/42

[58] Field of Search ..... 114/343, 345, 114/346, 351, 357, 361, 363, 364; 441/35, 40–43, 129–131, 255; 440/106–109; 43/55, 56

[56] References Cited

U.S. PATENT DOCUMENTS

| | | | |
|---|---|---|---|
| 148,279 | 3/1874 | Beach | 440/109 |
| 1,764,852 | 6/1930 | Phillips | 441/131 |
| 1,996,576 | 4/1935 | Hegewaldt | 441/130 |
| 2,080,216 | 5/1937 | Rea | 441/131 |
| 2,377,963 | 6/1945 | Rabjohn | 114/345 |
| 2,747,204 | 5/1956 | Erickson et al. | 114/351 |
| 2,894,270 | 7/1959 | Manthos | 441/131 |
| 3,659,298 | 5/1972 | Edwards | 114/345 |
| 3,694,835 | 10/1972 | Casey et al. | 114/345 |
| 3,935,607 | 3/1976 | Cantwell et al. | 114/345 |
| 4,063,320 | 12/1977 | Neumann et al. | 114/345 |
| 4,082,049 | 4/1978 | Nicol | 114/354 |
| 4,160,299 | 7/1979 | Hilbern | 441/131 |
| 4,290,156 | 9/1981 | Rawson | 114/364 |
| 4,547,355 | 7/1986 | Kirby | 114/353 |
| 4,693,691 | 9/1987 | DeYoe | 441/129 |
| 4,700,648 | 10/1987 | Trefethern et al. | 114/363 |
| 4,771,722 | 9/1988 | Tihany | 441/131 |
| 4,795,387 | 1/1989 | Morgan | 441/131 |
| 5,050,526 | 9/1991 | Nelson | 114/364 |
| 5,090,930 | 2/1992 | Walden | 441/131 |
| 5,101,753 | 4/1992 | Hull | 114/345 |
| 5,170,738 | 12/1992 | Patten | 114/362 |
| 5,171,178 | 12/1992 | Creek | 441/132 |
| 5,183,002 | 2/1993 | Parker | 114/353 |
| 5,217,400 | 6/1993 | Creek | 441/132 |
| 5,290,196 | 3/1994 | Steel | 441/130 |

*Primary Examiner*—Robert J. Oberleitner
*Assistant Examiner*—Clifford T. Bartz
*Attorney, Agent, or Firm*—Harry M. Cross, Jr.

[57] ABSTRACT

A flotation system for supporting a person on a body of water for a variety of activities comprises an endless inflatable tube for supporting a person on a body of water, the tube having a circumference that defines an interior space extending from a stern end of the tube to a bow end of the tube. At least a portion of the interior space is open at the stern end. A seat platform is secured to the tube within the interior space at a location whereby a person sitting on the seat platform may face the stern end and extend his feet and legs through the open portion of the interior space into the body of water. The flotation system comprises a storage pack adapted to fit between the seat platform and the bow end. The storage pack is designed to hold the water vehicle in its uninflated condition for stowage and may be designed to be carried (much like a suitcase) or worn (much like a backpack) or both. Auxiliary items may be incorporated into the flotation system, such as a motor mount, a scuba mount, or a camouflage covering.

21 Claims, 8 Drawing Sheets

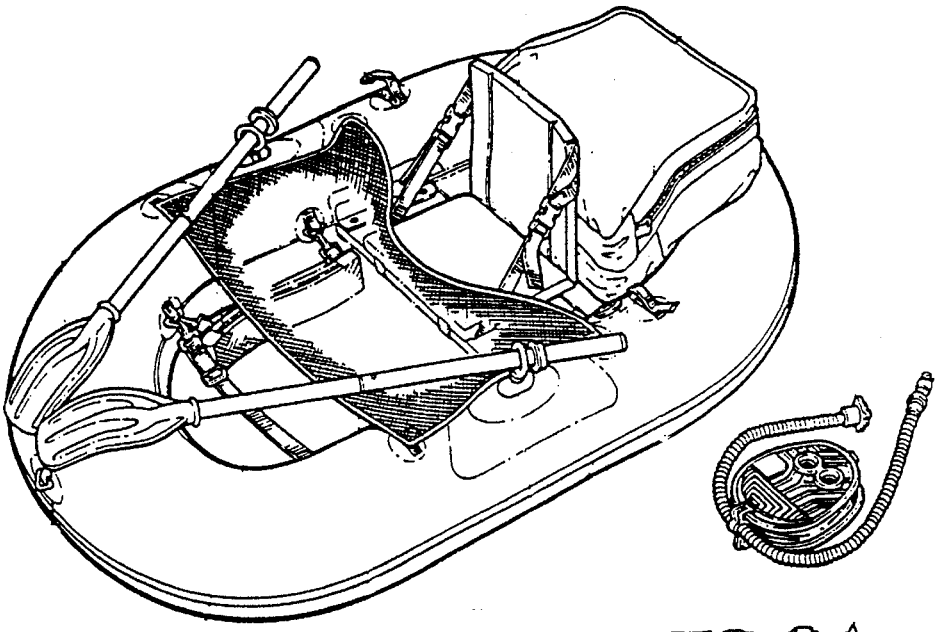
FIG. 8A
FIG. 8
FIG. 9
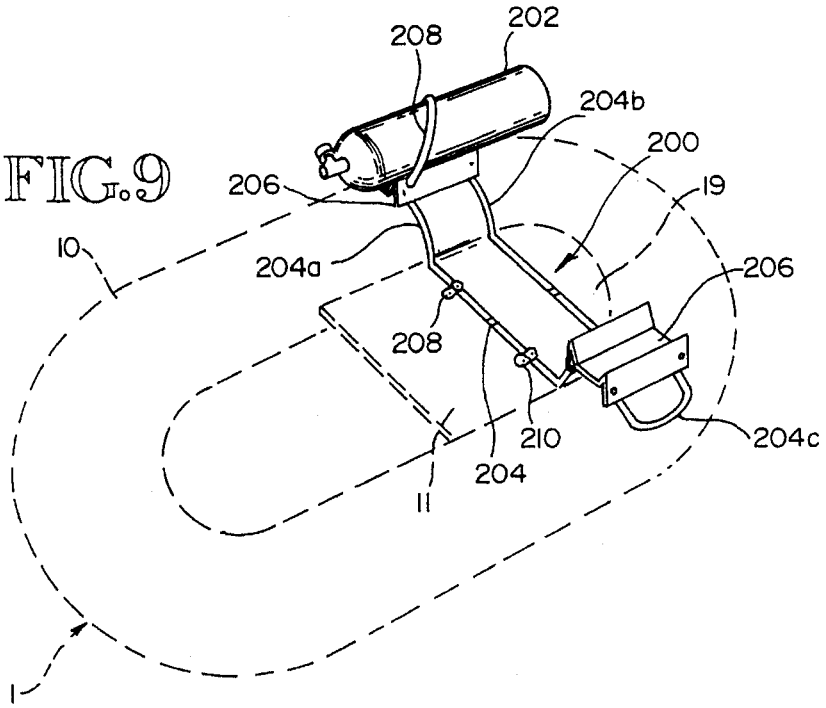

MULTI-SPORT FLOTATION SYSTEM

This application is a continuation-in-part of application Ser. No. 07/861,750, filed Apr. 1, 1992, now U.S. Pat. No. 5,297,978, issued Mar. 29, 1994.

BACKGROUND OF THE INVENTION

1. Field of the Invention

This invention relates to inflatable flotation tubes and one-man float crafts for use as a fishing craft, a bird hunting blind, a scuba-diving platform, or a wildlife viewing/photography station.

2. Brief Description of the Prior Art

Single operator, multi-purpose, inflatable water vehicles are known. Such single operator, inflatable water vehicles include, among others, canoes, rafts, kayaks, and lifeboats. The present invention is particularly concerned with a single operator, multipurpose water vehicle intended for use in fishing, waterfowl hunting, scuba and skin diving and other similar recreation. Such a water vehicle ideally allows for ease of manual propulsion, with the operator's hands free to operate other equipment. Such a water vehicle should function with a low center of gravity yet allow support of the operator's pelvis and torso above the water line, enabling use of the water vehicle on bodies of water where the danger of the operator's body striking submerged objects is a concern. Such a water vehicle should be constructed with suitable stowage for accoutrements. Such a water vehicle should be easily stowed and transported upon deflation.

Inflatable life boats or rafts of various types which are intended for use on stationary or flowing bodies of water are known. Examples of inflatable boats and rafts utilizing endless tubular hulls are disclosed in U.S. Pat. No. 2,370,069, issued to F. F. Patten; U.S. Pat. No. 2,456,086, issued to Schwall, Jr.,; U.S. Pat. No. 2,894,270, issued to A. G. Manthos; and U.S. Pat. No. 3,935,607, issued to R. R. Cantwell and H. J. Pohl.

Examples of inflatable boats or other water devices which provide improved mobility and stability for operators such as fisherman have been previously described. The water saddle, U.S. Pat. No. 2,894,270, issued to A. G. Manthos, is constructed of a generally ovoid endless inflatable tube having an inner fabric deck with two holes through which the operator's legs may be submerged into the water. The operator is suspended with the upper body above water by straddling the flooring between the two leg-holes. The occupant's weight is supported solely by a thin strip of fabric running under the operator's groin. Prolonged periods of use will lead to considerable discomfort. Lack of operator back support does not allow optimal leverage for foot propulsion. The water saddle is not configured to promote ease of portage.

The foot propelled water vehicle, U.S. Pat. No. 4,101,996, issued to Mickulecky, designed for use by fishermen, is constructed of a rigid oval buoyant shell incorporating three stowage compartments. The operator sits in a semi-reclined position with only his feet extending over the side of the water vehicle. Such operator positioning decreases thrust potential and leads to inadvertent splashing while kicking. The rigid construction makes stowage and transportation by a single individual difficult as well as increasing the danger of capsizing during operation.

The buoyant bathing implement, U.S. Pat. No. 1,996,576, issued to E. C. Hegewaldt, and the float conveyer, U.S. Pat. No. 2,080,216, issued to H. R. Rea, are water vehicles which provide for an open-bottom inflatable endless tube upon which a rigid seat platform is suspended. Both provide for a low center of gravity and stability, with the seats being suspended below water level. Seating the operator below the water line increases drag, reduces mobility, precludes extended use in cold water, and provides greater opportunity for the operator to strike submerged objects.

"Float tubes" are designed and marketed in the United States as self-propelled water vehicles intended for use by fishermen. The general construction utilizes a circular inflatable tube with the approximate dimensions of a tire "inner tube". An underwater harness suspends the operator up to his chest in water, allowing foot propulsion while freeing the hands. The operator generally wears chest-waders to remain dry and scuba fins to maximize propulsion. Suspending the operator as such reduces maneuverability because of drag. The operator's position limits use in water less than approximately four and one-half feet deep as well as use in flowing water, where the operator may strike submerged objects. Excessive body heat loss restricts extended use in cold water.

The Water Otter, a water vehicle marketed in the United States and intended for use by fishermen, is made of two inflatable pontoons held together by an aluminum frame which incorporates a seat platform. There is an opening in the frame behind the operator into which an ice chest may be placed. This water vehicle is intended for use by fishermen and allows foot propulsion while maintaining the torso of the operator above water. The operator sits approximately one foot above the water's surface, resulting in a high center of gravity and reduced stability in rapidly flowing water. Only the operator's feet and ankles are to be submerged for propulsion, which produces suboptimal thrust efficiency. The rigid heavy construction precludes ease of stowage and transportation by a single operator. The pontoons make for difficulty in turning the craft against the direction of the current flow and therefore make for difficultly in maneuvering the craft. The vehicle is not designed for use with oars.

What was needed was a water vehicle with a low center of gravity when occupied by the operator, which allows the operator's torso to remain above the water while simultaneously allowing foot propulsion, or alternatively, propulsion using oars. The water vehicle needed to provide an adequate amount of easy access to wet and dry stowage and be lightweight, collapsible, and transportable by a single operator. None of the above discussed prior art meets all these requirements.

The present invention constitutes an improvement over previous apparatus for optimal utility during operation or portage by providing a lightweight, manually propelled, easily toted, water vehicle. The present invention is directed to overcome the aforementioned problems, thereby providing an improved fishing, waterfowl hunting and recreational boating experience.

SUMMARY OF THE INVENTION

It is an object of the present invention to provide a water vehicle which is suited for use by fishermen, waterfowl hunters, scuba or skin divers, and other recreational boaters, with emphasis on ease of use, accomplished by improved safety, maneuverability, access to stowage area during operation, increased stowage capacity, and portability by a single operator as an integrated lightweight tote.

Another object of the present invention is to provide a water vehicle with removable, partially submerged removable wet wells having access by the operator for live stowage of bait and fish. Another object of the present invention is to provide a water vehicle having stowage compartments which can be accessed during operation and which, upon removal from the water vehicle, can be incorporated into an integrated lightweight tote.

Another object of the present invention is to provide a method by which a water vehicle with attached accessories may be stowed or transported as a lightweight compact shoulder tote or a suitcase tote in a single, suitably designed removable, dry, duffel day-pack and/or backpack.

To achieve these objects, a water vehicle is disclosed that comprises part of a flotation system for supporting a person on a body of water for a variety of activities. The water vehicle comprises an endless inflatable tube for supporting a person on a body of water, the tube having a circumference that defines an interior space extending from a stern end of the tube to a bow end of the tube. At least a portion of the interior space is open at the stern end. A seat platform is secured to the tube within the interior space at a location whereby a person sitting on the seat platform may face the stern end and extend his feet and legs through the open portion of the interior space into the body of water. The flotation system may also comprise a storage pack adapted to fit between the seat platform and the bow end, and releasible fastening means for releasibly fastening the storage pack to the tube. The storage pack is preferably designed to hold the water vehicle in its uninflated condition for stowage and may be designed to be carried (much like a suitcase) or worn (much like a backpack) or both. Auxiliary items may be incorporated into the flotation system, such as a motor mount, a scuba mount, or a camouflage covering.

BRIEF DESCRIPTION OF THE DRAWINGS

FIGS. 8, 8A are perspective views illustrating additional features of the integrated flotation system of the invention, including a two-way high-volume pump for simultaneous inflating both compartments of the water vehicle, and a removable foot rest;

FIG. 9 is a perspective view of the water vehicle of the invention with an auxiliary scuba mount installed.

DESCRIPTION OF THE PREFERRED EMBODIMENT

Figure 1:
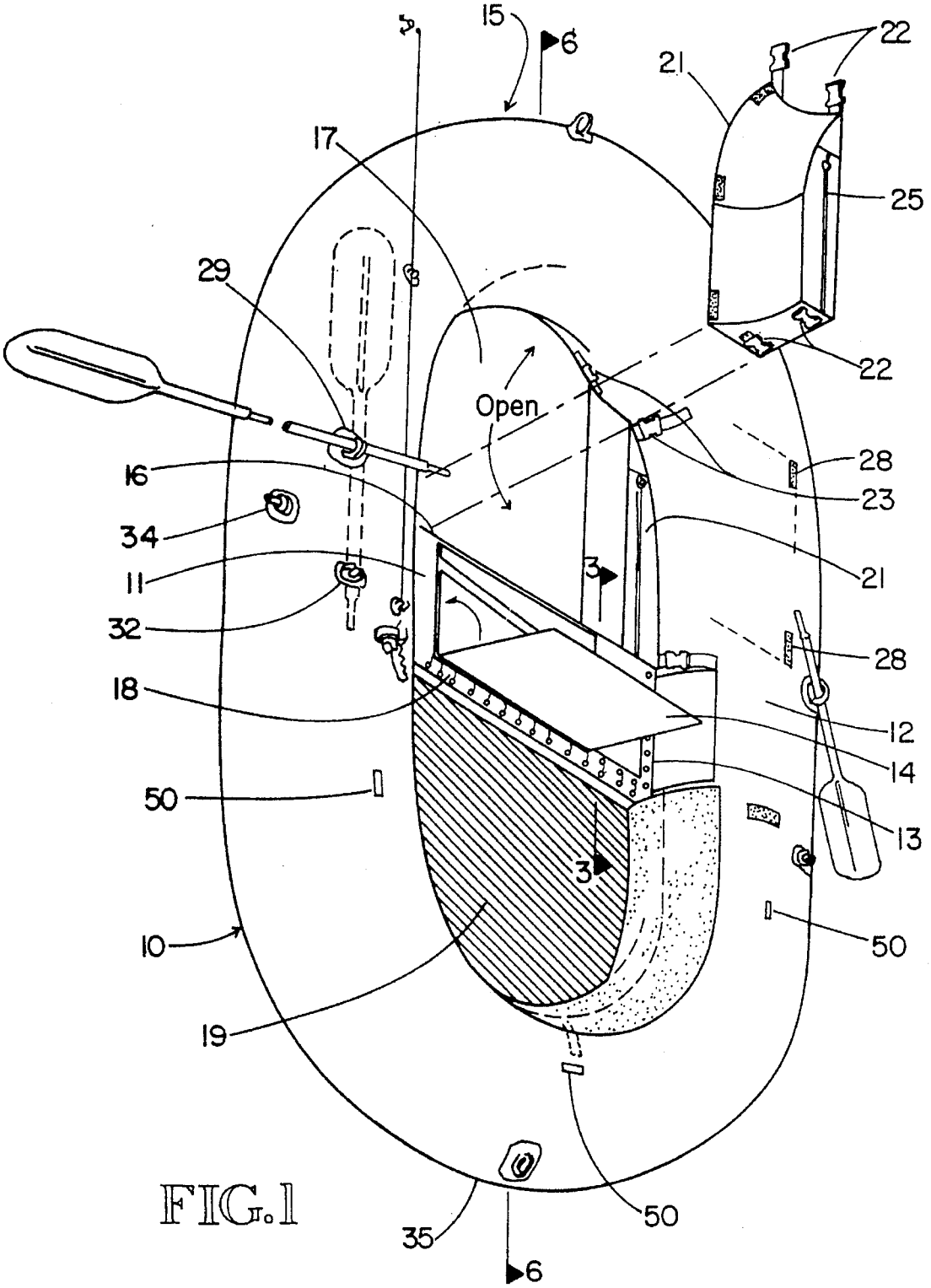
FIG. 1 is a perspective of a water vehicle according to the invention.

In one form of the flotation system the water vehicle comprises in combination, an ovoid, inflatable tube which is internally divided into forward and aft independently inflatable chambers; a rigid seat platform; a means of attaching the rigid seat platform to the ovoid, inflatable tube; a dry duffel stowage compartment; a means of attaching the dry duffel stowage compartment to the ovoid, inflatable tube; a removable, dry, duffel day-pack; a means of attaching the removable, dry, duffel day-pack to the dry duffel stowage compartment; a plurality of removable wet wells; a means of attaching the removable wet wells to the ovoid, inflatable tube; a means of attaching the removable wet wells to the removable, dry, duffel day-pack; a backpack; a means of attaching the removable, dry, duffel day-pack and removable wet wells to the backpack; a means of securing the backpack within the dry duffel stowage compartment; a plurality of circular oar locks; a plurality of oar clips complimentary to the circular oar locks; a means of attaching the oar locks to the ovoid, inflatable tube; a fly apron; and a means of attaching the fly apron to the ovoid, inflatable tube.

The bottom of the water vehicle is open from the stern of the boat, the direction in which the operator faces, forward up to and under the rigid seat platform. This open-floored configuration allows the operator's legs to extend into the water for propulsion.

The bottoms of the removable wet wells extend below the water's surface when the removable wet wells are attached to the water vehicle and are constructed of a water porous mesh which allows water to enter into and circulate through the removable wet wet wells may be attached to the backpack by the fastening of a plurality of buckles, four female halves of the buckles being permanently attached to the front (side without shoulder straps) of the top of the backpack and four male halves of the complementary wells, and allowing for the stowage of live fish or bait. The tops of the removable wet wells have midline zippers which allow ease of access therein during water vehicle operation. The removable wet wells are secured to the water vehicle by a plurality of complementary buckles located on both ends of the removable wet wells. The female halves of the buckles, are permanently attached to the ends of the removable wet wells, and complimentary male halves of the buckles are permanently attached to the stern interior aspect of the ovoid, inflatable tube. The removable wet wells attach to the interior lateral wall of the water vehicle and extend from the stern margin of the rigid seat platform to the stern of the water vehicle, allowing ease of access to the removable wet well contents by the operator during water vehicle operation.

The removable wet wells may be removed from the water vehicle and secured to the removable, dry, duffel day-pack for transport of the removable wet wells and contents without the risk of soiling the contents of the removable, dry, duffel day-pack or the backpack.

A plurality of circular oar locks and oar clips are permanently attached bilaterally to the top of the ovoid, inflatable tube. When the operator wishes to move the water vehicle through the water at a speed greater than can be achieved by foot propulsion, the operator may utilize oars. Oars ideally would break down, through use of a telescopic joint, into two pieces of equal length which allows stowage within the removable, dry, duffel day-pack.

A fly apron removably attaches to the upper surface of the lateral walls of the ovoid, inflatable tube. The fly apron spans the entire width (port to starboard) of the water vehicle. The fly apron allows loose fishing line to be supported above the water, preventing tangling of said line in the operator's legs during raft operation. The fly apron attaches to the upper surface of the lateral walls of the ovoid, inflatable tube by means of fabric fasteners.

The forward and aft air chambers of the ovoid, inflatable tube are completely deflated by releasing air through the two air valves located on the interior surface of the lateral walls of the ovoid, inflatable tube. The bow portion of the ovoid, inflatable tube (that portion positioned forward of the seat platform) is reflected back over the seat platform by creasing and folding at the forward (bow oriented) margin of the seat platform. Each lateral wall of the water vehicle is next folded toward the bow to stern midline of the water vehicle, such that the margins of the two lateral walls of the tube now approximate at the bow to stern midline. The folding process is completed by folding the rigid seat platform over the approximated lateral walls repeatedly in a direction moving toward the stern of the water vehicle. The length of each fold is determined by the bow to stern length of the rigid seat platform plus additional length added by the wrapping of the inflatable material around the rigid seat platform.

The removable, dry, duffel day-pack with attached removable buckles being permanently attached to the front (side without shoulder straps) of the convex top and flat bottom of the removable, dry, duffel day-pack. By this method the backpack, water vehicle, removable, dry, duffel day-pack, removable wet wells, and various accoutrements may be transported by a single operator as an integrated tote unit. The exterior attachment of the removable, dry, duffel day-pack and removable wet wells to the backpack increases stowage capacity of the integrated backpack unit and prevents the soiling of backpack or removable, dry, duffel day-pack contents by the removable wet well contents. The folded water vehicle and collapsed oars may be stowed in the removable, dry, duffel day-pack. The removable wet wells may be attached to the sides of the removable, dry, duffel day-pack by fastening the plurality of complementary buckles. The integrated tote may now be transported as a suitcase using the handle or as a day-pack using the shoulder straps.

Figure 2:
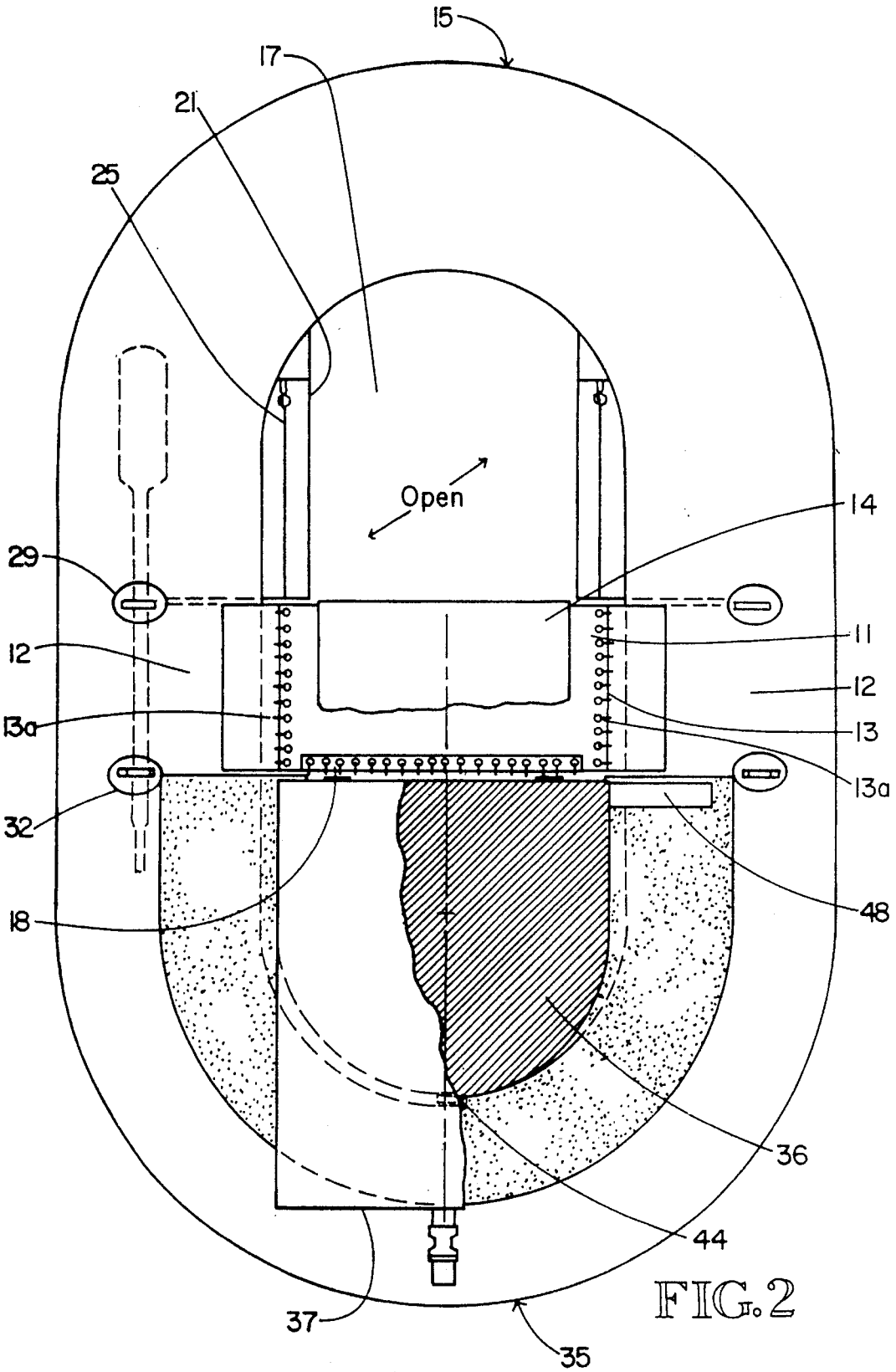
FIG. 2 is a top plan view of the water vehicle illustrating the removable wet wells, removable, dry, duffel day-pack and backpack stowed according to the invention.
Figure 3:
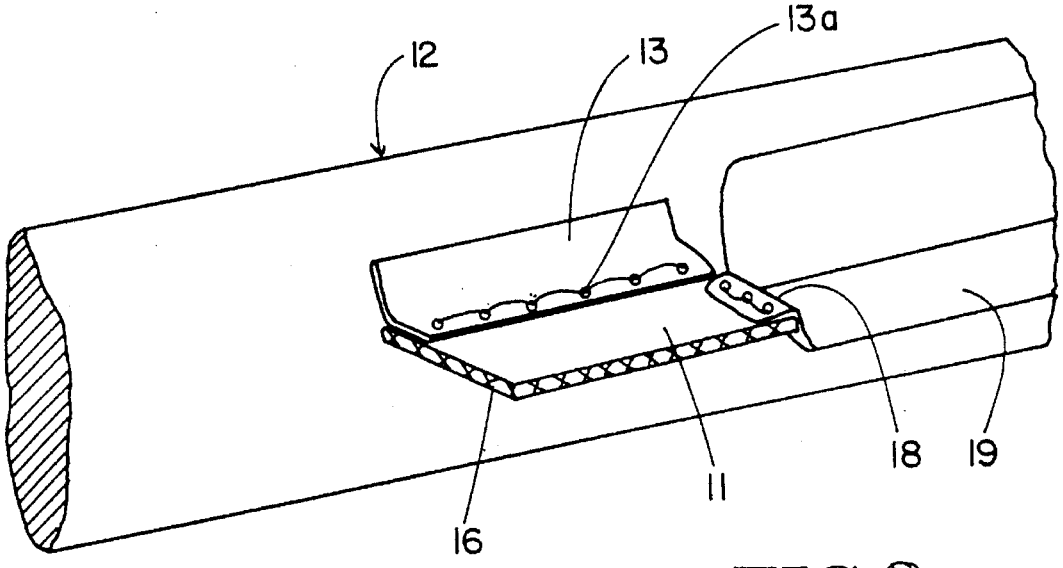
FIG. 3 is a cross-sectional view on line 2—2 of FIG. 1 with wet wells removed.

Referring now to the drawings and first to FIGS. 1, 2 and 3 thereof, it may be seen that the water vehicle of the present invention, has a configuration of a raft, including an ovoid, inflatable, tube 10 of flexible, lightweight, water impervious, tear resistant material such as natural or synthetic rubber, polyvinyl chloride, fabric reinforced rubber or polyvinyl chloride or Hypolon®. Suspended approximately three to four inches above the water line is a rigid seat platform 11 of marine plywood, fiberglass, or other material capable of supporting the weight of an operator. The rigid seat platform 11 spans the port to starboard distance between the interior aspect of the lateral walls 12 of the ovoid, inflatable tube and attaches to the lateral walls 12 by lacing to a flap of flexible fabric 13.

The water vehicle will allow for water surface transportation of up to 500 pounds of gross weight, including stowage of sufficient camping and sporting equipment to facilitate the undertaking of extended float trips. FIGS. 2 and 3 illustrate the attachment of the rigid seat platform 11 to the lateral walls 12 of the ovoid, inflatable tube 10 by lacing through holes in the rigid seat platform 11 to a flexible fabric flap 13 through a plurality of grommets 13*a* in the free edge of the flexible fabric flap 13. The rigid seat platform 11, is attached to the midline of the interior lateral walls of the ovoid, inflatable tube 10 approximately equally distanced from the bow 35 and stern. The rigid seat platform is suspended approximately four inches above the water's surface when the water vehicle is in use. Attachment of the rigid seat platform 11 to the ovoid, inflatable tube 10 is accomplished by lacing grommets in the rigid seat platform 11 to grommets in a flexible, sturdy material attached to the midline of the interior lateral walls of the ovoid, inflatable tube 10. The flexible sturdy material attached to the midline of the interior lateral walls of the ovoid, inflatable tube 10 extends from the midline of the interior lateral walls of the ovoid, inflatable tube 10 the full length of the bow 35 to stern width of the rigid seat platform 11. The flexible fabric flaps 13 are permanently attached to the upper surfaces of the lateral walls 12. Upon the rigid seat platform 11 may be placed a removable fabric or molded seat 14 providing back support to the operator. The back of the molded seat 14 may be folded over upon the bottom of the molded seat 14 following removal from the rigid seat platform 11, allowing convenient stowage.

Figure 4:
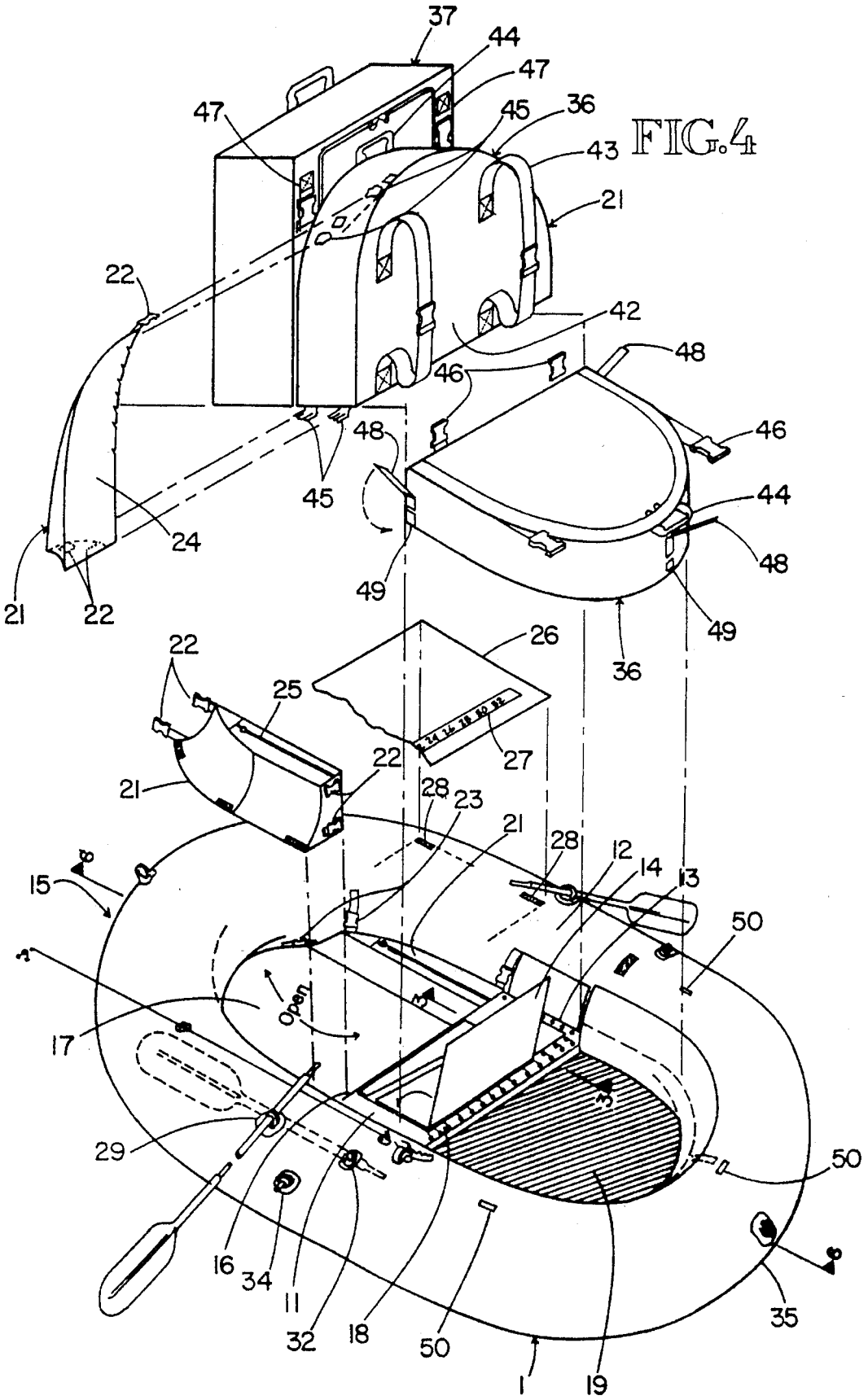
FIG. 4 is a perspective of the integrated flotation system comprising the removable, dry, duffel day-pack and backpack as they insert into the dry well compartment and the removable wet wells as they attach to the interior lateral walls of the ovoid, inflatable tube, according to the invention.

FIG. 4 illustrates that the bottom 17 of the water vehicle is open to the water's surface, extending to the stern 15 of the water vehicle from the aft margin 16 of the rigid seat platform 11. Extending to the bow 35 of the water vehicle from the forward margin 18 of the rigid seat platform 11 is a dry duffel stowage compartment 19 having a flexible fabric material floor which is suspended approximately two inches above the water line. The flexible fabric material floor attaches to the upper interior aspects of the ovoid, inflatable tube 10 and to the forward margin 18 of the rigid seat platform 11 by lacing through holes in the rigid seat platform 11 and complementary grommets in the flexible fabric material floor. The dry duffel stowage compartment 19 as provided by the flexible fabric material floor may be used for the loose stowage of fishing equipment, or provide for the stowage of a removable, dry, duffel-day pack and backpack.

Extending from the forward aspect of the rigid seat platform 11 to the bow 35 and along the lateral interior aspects of the ovoid, inflatable tube 10 is a dry duffel stowage compartment 19. A flexible, sturdy material is attached to the top of the ovoid, inflatable tube 10 extending from the forward aspect of the rigid seat platform 11 to the bow 35 and along the lateral interior aspects of the ovoid, inflatable tube 10 and draping into the water vehicle to a level approximately two inches below the rigid seat platform 11. The flexible, sturdy material extends from the bow 35 to the bow edge of the rigid seat platform 11, where the flexible, sturdy material is permanently laced to the rigid seat platform 11 through grommets placed in the bow edge of the rigid seat platform 11 and stern edge of the flexible dry duffel compartment 19. The dry duffel stowage compartment 19 is thereby formed which is sufficiently large to accommodate sporting equipment that need not necessarily remain dry during water vehicle operation.

A removable, dry, duffel day-pack 36 is designed to fit snugly into the contours of the dry duffel stowage compartment 19. The removable, dry, duffel day-pack 36 is designed to attach to the water vehicle within the dry duffel stowage compartment 19 during water vehicle operation. The removable, dry, duffel day-pack 36 is configured utilizing a convex contour complementary to the interior curvature of the ovoid, inflatable tube 10. The removable, dry, duffel day-pack 36 has a flat base which complements the straight edge contour edge of the rigid seat platform. A zipper extends from the base of the removable, dry, duffel day-pack 36 around the edge of the convex contour of the removable, dry, duffel day-pack 36 and back to the base, which zipper allows access into the removable, dry, duffel day-pack 36 by the operator when the removable, dry, duffel day-pack 36 is secured into place within the dry duffel stowage compartment 19. The removable, dry, duffel day-pack 36 is of suitable dimensions to allow the deflated and folded water vehicle and accoutrements to completely fit within for stowage and/or portage. When the removable, dry, duffel day-pack 36 is removed from the dry duffel stowage compartment 19, the removable, dry, duffel day-pack 36 may be worn on the back of the operator through the use of adjustable shoulder straps 43 incorporated onto the back of the removable, dry, duffel day-pack 36 or carried as a suitcase tote by means of an incorporated handle 44. The removable, dry, duffel day-pack 36 also has a plurality of buckles 45 which allow attachment of removable wet wells 21 as integrated components to the removable, dry, duffel day-pack 36 for ease of stowage and portage. FIG. 4 further illustrates the insertion of the dry duffel-day pack 36 or the integrated tote composed of the removable, dry, duffel day-pack 36 and the backpack 37 into the dry duffel stowage compartment 19 of the water vehicle as well as the insertion of the removable wet wells 21 into the water vehicle. A plurality of fabric fastener tabs 48 permanently attach to the removable, dry, duffel day-pack 36. The tabs 48 mate with complementary fasteners 49 permanently attached to the removable, dry, duffel day-pack 36. The tabs 48 also mate with additional fasteners 50 on the upper surface of the ovoid, inflatable tube 10 of the water vehicle above the dry duffel stowage compartment 19. Fastening the integrated tote within the dry duffel stowage compartment 19 allows for stowage of considerable amounts of sporting goods and camping equipment during water vehicle operation.

A plurality of removable wet wells 21 intended for the stowage of live bait or fish attach to the interior aspect of the lateral walls 12 of the ovoid, inflatable tube 10 through the use of a plurality of buckles. The plurality of removable wet wells 21 complement the convex curvature of the interior lateral walls of the ovoid, inflatable tube 10. The female portions 22 of the buckles are permanently attached to the removable wet wells 21 and the complementary male portions 23 of the buckles are permanently attached to the interior aspects of the ovoid, inflatable tube 10. The removable wet wells 21 when attached to the ovoid, inflatable tube 10, are partially submerged in the water during operation of the water vehicle. The bottoms of the removable wet wells 21 are composed of a nylon mesh material 24, allowing water to enter and circulate through the removable wet wells 21, keeping bait or caught fish alive. On the top of each removable wet well 21 is a zipper 25 which allows access to the contents of the removable wet wells 21 during water vehicle operation.

A fly apron 26 of a flexible fabric with a tape measure 27 is secured to the upper surface of the lateral walls 12 of the ovoid, inflatable tube 10 through the use of a plurality of fabric fasteners 28, and stretches across the port to starboard dimension of the water vehicle. The fly apron 26 allows fly fishermen to collect stripped fishing line between casts, thereby keeping stripped line out of the water and preventing tangling.

A plurality of circular oar locks 29 are permanently cemented to the upper surfaces of the lateral walls 12 of the ovoid, inflatable tube 10, just aft of the rigid seat platform 11, and allow the operator to row the water vehicle. When not in use, the oars may be secured by clipping the oar handles into a plurality of forward mounted oar clips 32 permanently cemented to the upper surfaces of the lateral walls 12 of the ovoid, inflatable tube 10.

A fishing rod fastener may also be permanently cemented to the upper surface of the lateral walls 12 of the ovoid, inflatable tube 10.

Two air valves 34 allow for inflation and deflation of the two separate internal air compartments of the ovoid, inflatable tube 10.

Figure 5:
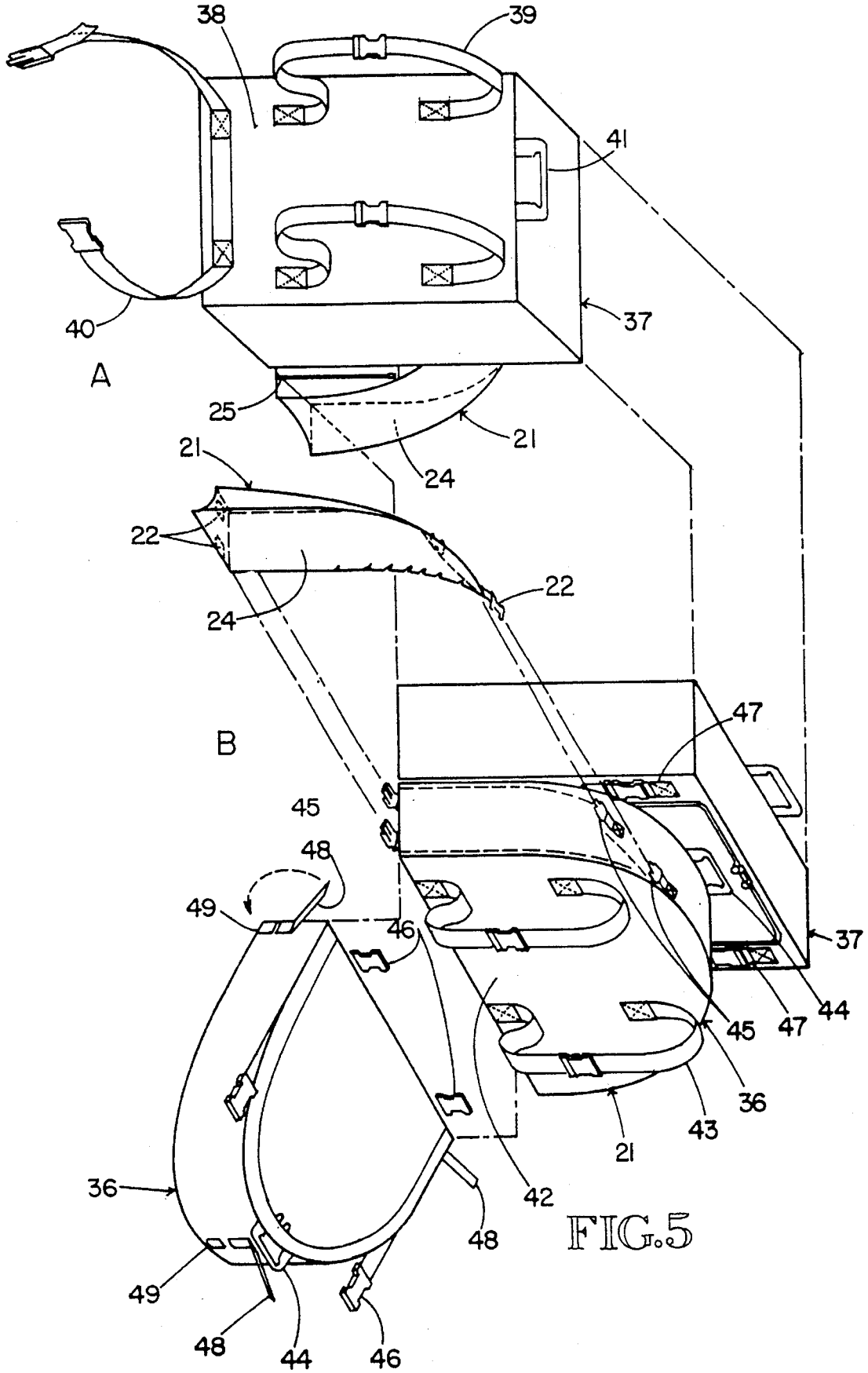
FIG. 5 is a perspective of an integrated flotation system comprising removable wet wells, removable dry, duffel day-pack, and backpack according to the invention.

FIG. 5 illustrates an integrated tote comprising a removable, dry, duffel day-pack 36, backpack 37, and removable wet wells 21. A plurality of complementary buckles 22, 45 allow the removable wet wells 21 to attach to the removable, dry, duffel day-pack 36. A plurality of buckles 46, 47 allow the backpack 37 to attach to the removable, dry, duffel day-pack 36. FIG. 5 illustrates the back 38 of the backpack 37 with a set of shoulder straps 39, a waist strap 40, and a handle 41 permanently affixed. A portion of a removable wet well 21 can also be seen in FIG. 5 as attached to the removable, dry, duffel day-pack 36. The removable wet wells 21 and the removable, dry, duffel day-pack 36 are attached to the front aspect of the backpack 37. The water permeable nylon mesh 24 comprising the bottom of the removable wet wells 21 are shown. FIG. 5 illustrates the back 42 of the removable, dry, duffel day-pack 36 with shoulder straps 43 and handle 44 permanently affixed. A removable wet well 21 is shown attached and a second removable wet well 21 detached from the sides of the removable, dry, duffel day-pack 36 through the use of a plurality of complementary buckles 22, 45, the female portions 22 being permanently attached to the removable wet wells 21 and the male portions 45 being permanently attached to the removable, dry, duffel day-pack 36. The removable, dry, duffel day-pack 36 further attaches to the front of the backpack 37 through a plurality of complementary buckles, the female portions 46 being permanently attached to the removable, dry, duffel day-pack 36 and the male portions 47 being permanently attached to the backpack 37.

Figure 6:
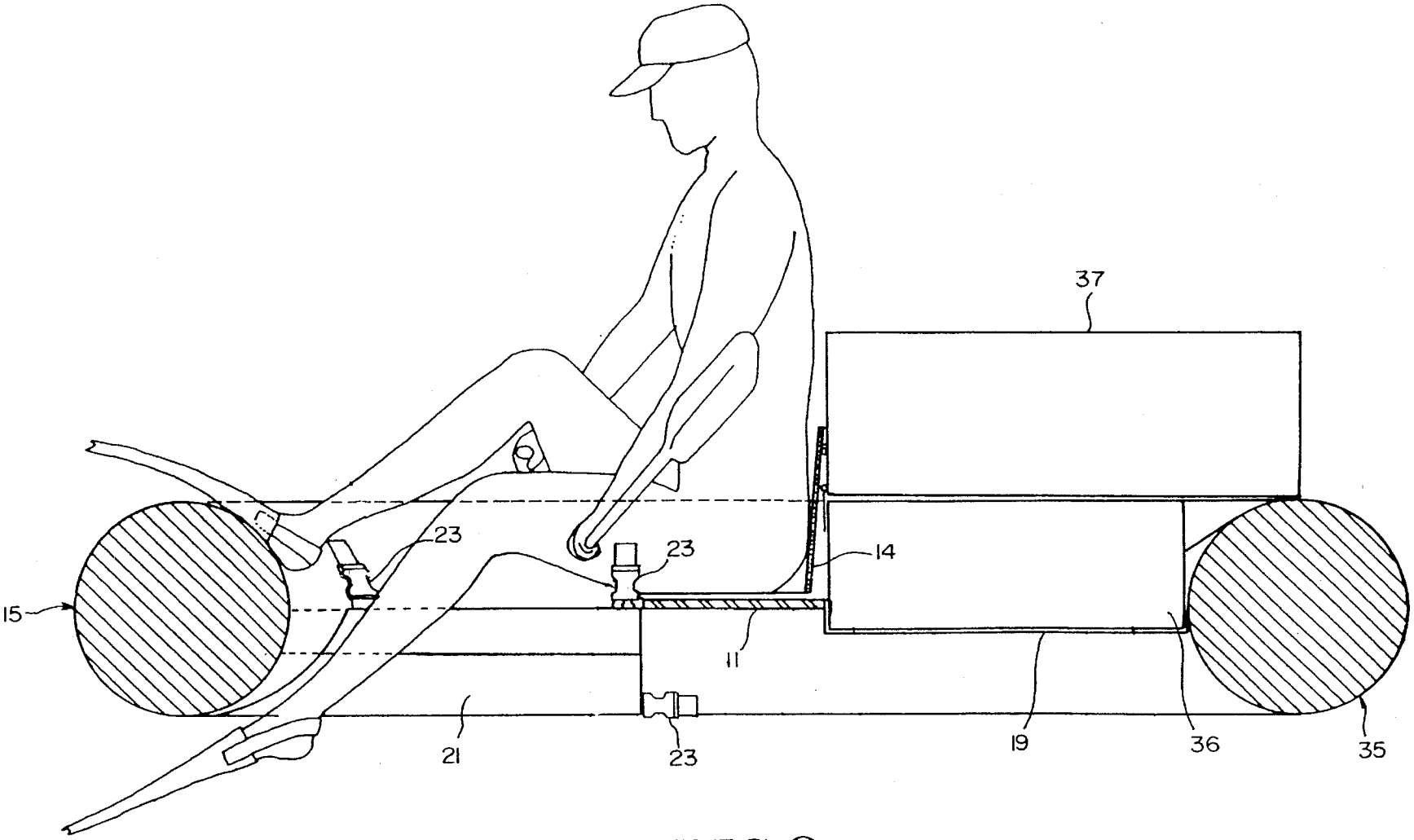
FIG. 6 is a cross-sectional view on line 6—6 of FIG. 1 according to the invention.
Figure 7B:
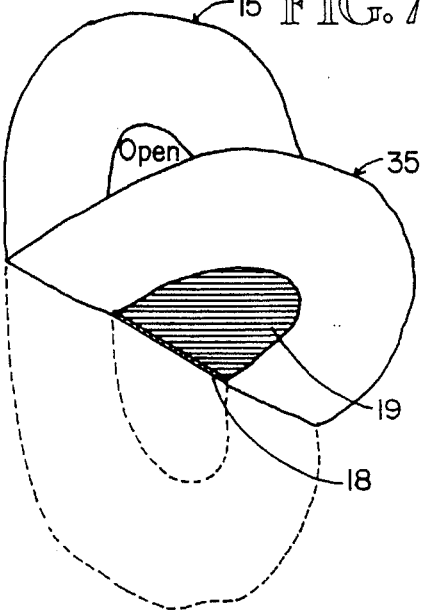
FIGS. 7(*a–e*) are views illustrating one embodiment of a method by which the deflated water vehicle and collapsible oars may be stowed within the removable, dry, duffel-day-pack according to the invention.
Figure 7C:
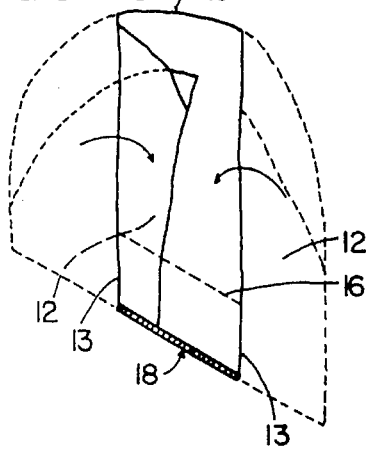
Figure 7D:
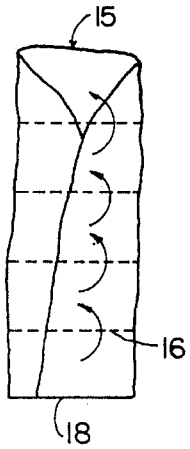
Figures 1, 7D:
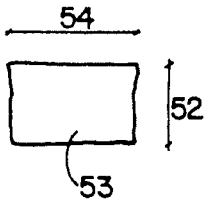
Figure 7A:
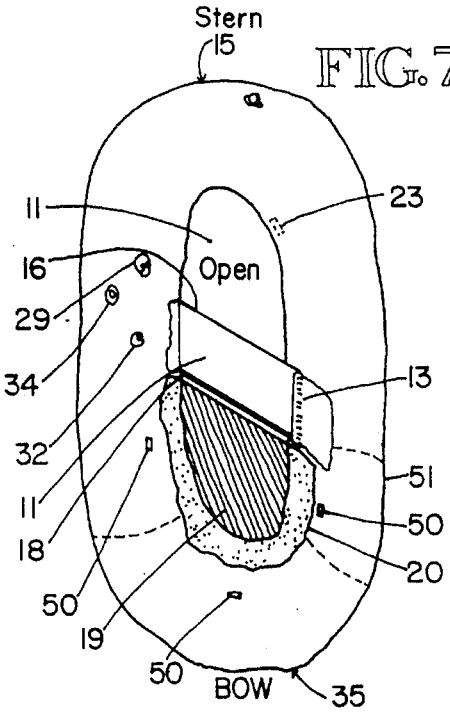
Figure 7E:
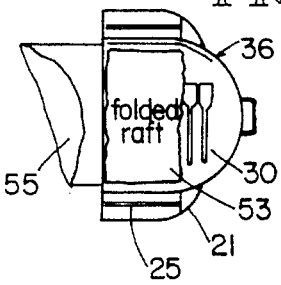

A backpack 37 provides stowage of the deflated water vehicle, detachable seat, collapsible oars, air pump, and other ancillary sporting equipment. The backpack 37 attaches to the removable, dry, duffel day-pack 36 during water vehicle operation. The backpack 37 attaches to the water vehicle above the dry duffel stowage compartment 19 through attachment to the removable, dry, duffel day-pack 36, said removable, dry, duffel day-pack 36 being secured to the water vehicle using the fabric (Velcro®) fasteners. The backpack 37 attaches to the removable, dry, duffel day-pack 36 through the use of a plurality of buckles 46, 47, four female halves of complementary buckles 46 being permanently affixed to both sides of the top and bottom of the backpack 37 (as defined when backpack is carried upon the back of the operator). The female buckle halves 46 mate with complementary male buckle halves 47 which are permanently affixed to the front surface (side without shoulder straps) of the removable, dry, duffel day-pack 36. The plurality of buckles affixed to the backpack 37 and removable, dry, duffel day-pack 36 afford a fastening means by which the removable, dry, duffel day-pack 36 and removable wet wells 21 may be attached as an integrated unit to the backpack 37. By fastening the removable, dry, duffel day-pack 36 to the front (side without shoulder straps) of the backpack 37, the removable wet wells 21 may be attached to the sides of the removable, dry, duffel day-pack 36 using the plurality of buckles 45, allowing the operator to carry the backpack 37, removable, dry, duffel day-pack 36 and removable wet wells 21 as an integrated tote. FIG. 6 illustrates an operator of the water vehicle sitting upon a removable seat 14 placed upon the rigid seat platform 11 with his back facing the bow 35 of the water vehicle. The operator's legs are intended to be extended into the water through the bottom 17, allowing foot propulsion of the water vehicle while allowing the operator's hands to remain free for fishing or waterfowl hunting. The operator will ideally wear leg or chest waders and scuba fins to maximize comfort and propulsion efficiency. Alternatively the operator may use oars for propulsion after raising his legs out of the water and resting his feet upon the stern portion 15 of the ovoid, inflatable tube 10.

FIG. 7 illustrates a method by which the deflated water vehicle, with removable wet wells 21, dry duffel-day pack 36, and backpack 37 all removed may be folded and inserted into the removable, dry, duffel day-pack along with ancillary components, for example, a removable seat 14, oars, and fly apron 26. The removable seat 14, removable wet wells 21, oars, removable, dry, duffel day-pack 36, and backpack 37 are removed from the water vehicle and the water vehicle is deflated. The bow 35 of the water vehicle is folded toward the stern 15 using a single fold made at the bow margin 18 of the rigid seat platform 11. The two lateral walls 12 of the water vehicle are then folded toward the bow to stern midline of the water vehicle, overlapping each other as defined by two parallel folds 13 one each on each side of the water vehicle, which parallel folds 13 are correspondingly defined by the port to starboard width of the rigid seat platform 11. The deflated water vehicle is then folded toward the stern 15 using fold widths 52 defined by the forward to aft length of the rigid seat platform 11. The completely folded water vehicle will have a rectangular shape closely approximating the port to starboard width 54 and forward to aft length 52 of the rigid seat platform 11.

The front 55 of the dry duffel-day pack 36 may be unzipped and reflected back, allowing the folded water vehicle and ancillary water vehicle components to be stowed within. The folded water vehicle and ancillary components may then be transported by an operator within an integrated tote using the shoulder straps 43 or carried as a suitcase tote using the handle 44. Alternatively, the folded water vehicle and ancillary components may be stowed in the backpack 37, allowing the removable, dry, duffel day-pack 36, with the removable wet wells 21 attached, to serve as additional stowage compartments attached to the front of the backpack 37.

Above are described the preferred embodiments for components of the water vehicle. Other embodiments of various components can also be utilized. Other embodiments include encasement of the rigid seat platform 11 in a flexible, sturdy material, which material extends beyond the lateral aspects of the seat and are permanently attached to the interior lateral walls of the ovoid, inflatable tube 10. Another embodiment allows for the rigid seat platform 11 to merely sit across the lateral walls of the ovoid, inflatable tube 10 by the use of a frame which would curve up from the midline and over the top surface of the ovoid, inflatable tube 10.

Another embodiment of the dry duffel stowage compartment 19 would allow a flexible, sturdy fabric constituting the floor of the dry duffel stowage compartment 19 to be permanently attached to the midseam of the entire interior (concave) aspect of the ovoid, inflatable tube 10 and the forward aspect of the rigid seat platform 11 through the use of grommets and lacing. In another embodiment, the floor of the dry duffel stowage compartment 19 may be composed of a rigid material secured in place through the use of detachable connectors. Such an embodiment would afford a suspended dry duffel stowage compartment platform which could be easily unfastened from the ovoid, inflatable tube 10 and seat platform 11.

In another embodiment, the removable, dry, duffel day-pack 36 could be suspended above the water within the area defined as the dry duffel stowage compartment 19 through the use of detachable connectors, eliminating the need for a dry duffel stowage compartment flooring.

Another embodiment for attachment of the removable wet wells 21 to the water vehicle includes two adjustable cinch straps which encircle the entire ovoid, inflatable tube 10 and attach each to the bow and stern of the removable wet wells 21.

The combined elements of overall dimensions of the water vehicle, of the rigid seat platform 11, use of lightweight flexible and inflatable materials, use of collapsible oars, use of removable wet wells 21, use of removable, dry, duffel day-pack, overall stowage capacity of the removable, dry, duffel day-pack 36 and backpack 37, complementary attachment of the removable wet wells 21 to the removable, dry, duffel day-pack 36, and attachment to the backpack 37 provide ease of stowage of the entire water vehicle, accessories, and stowage components as a lightweight, integrated tote.

Specific features of the invention as described above additionally allow a method by which the water vehicle, accessories, and stowage compartments may be stowed and transported as a lightweight, integrated tote.

Specifically, the invention provides a water vehicle with lightweight removable wet and dry stowage compartments which are equipped with attachment means such that the removable wet wells 21, removable, dry, duffel day-pack 36 and backpack 37, upon removal from the water vehicle, may be attached to one another to allow portage by a single operator as an integrated pack unit. The removable wet wells 21 are removed from the water vehicle by unfastening the forward and aft buckles 45. The backpack 37 is removed from above the dry duffel stowage compartment 19 by unfastening the four buckles 46, 47 designed to secure the backpack 37 to the removable, dry, duffel day-pack 36. The removable, dry, duffel day-pack 36 is removed from the dry duffel stowage compartment 19 by unfastening the three fabric fasteners.

Referring to FIG. 9, a rack system 200 for a carrying one or two scuba-diving air tanks 202 comprises a steel frame 204 that is configured to extend from one side of the raft 1 across the bow portion adjacent seat platform 11, and arcuately up and over the upper surface of the inflatable tube 10 at each end to air tank mounting plates 206. Each mounting plate 206 will include a tank securing strap 208 to releasibly secure an air tank 202 to the mounting plate 206. The steel frame 204 extends in parallel side segments **204*a*, 204*b* across the bow portion to end arcuate segments 204*c*. From the seat platform 11 and across the bow portion to the arcuate segments 204*c*, the steel frame 204 is located just above the bow stowage compartment deck 19. Consequently, the stowage compartment is accessible from above and the backpack 37 and/or the dry duffel day pack 36 may be stowed on top of the steel frame 104 without significant interference from the steel frame. Frame mounting means 208, 210 detachably secure the sides of the steel frame 204 to the seat platform 11. The upper surface of the inflatable tube 10 carries the weight of the air tank 202 that is mounted to plate 206 and the extended steel frame stabilizes the plates 206 to keep them from tilting or rotating as a result of mounting means 208, 210 securing steel frame 204 to the seat platform 11**.

Referring to FIGS. 8 and 9, because of the flotations system's bottomless configuration, it is very convenient for a scuba diver to enter the water by simply sliding off the seat, and to return to the seat by coming up through the stern portion of the raft tube. The raft's deck, located behind the diver in the bow portion, is available for carrying diving accessories. The raft's storage bag clips to the raft above the deck to carry other personal gear. The scuba air tank mount attaches firmly to the rear edge of the seat platform and accommodates two air tanks. Heavy duty rubber straps hold the air tanks securely to each side of the mount. Strap means may be employed to releasibly strap the frame means arcuate segments 204*c* around the inflatable tube.

The foregoing is considered as illustrative only of the principles of the invention. It will be understood that each of the elements described above, or two or more together, may also find a useful application in other types of constructions differing from the types described above. Further, as numerous modifications and changes will readily occur to those skilled in the art, such as, but not restricted to, alternative means of affixing removable wet wells, dry duffel day-pack and backpack to the water vehicle and to each other, and the provision of additional stowage compartments to the water vehicle and means of appending such compartments upon the tote, it is not desired to limit the invention to the exact construction, configuration, and operation shown and described, and accordingly, all suitable modifications and equivalents may be resorted to, falling within the scope of the invention as claimed.

While the preferred embodiment of the invention has been described herein, variations in the design may be made. The scope of the invention, therefore, is only to be limited by the claims appended hereto.

The embodiments of the invention in which an exclusive property is claimed are defined as follows:

1. A flotation system for supporting a person on a body of water which comprises inflatable tube means providing a buoyant annular body when said inflatable tube means is inflated, said buoyant annular body having an inner wall with upper and lower surfaces and defining a bottomless interior whereby when said buoyant annular body is placed on said body of water said lower surface will be submerged in said body of water and said inner wall will be partially submerged in said body of water with said bottomless interior being exposed to said body of water, said bottomless interior having a stern portion and a bow portion; seat platform means secured to said inflatable tube means across said buoyant annular body and at an elevation between said upper and lower surfaces whereby when said inflatable tube means is inflated and said buoyant annular body is placed on said body of water said seat platform will be located above the surface of said body of water, said seat platform means extending substantially completely across said buoyant annular body and so dividing said bottomless interior into said stern portion and said bow portion whereby a person sitting on said seat platform means may extend his feet and legs through said stern portion into said body of water and propel said flotation system by moving his lower legs and feet without sitting in said body of water; storage pack means mountable in said bow portion, said storage pack means being of a size suitable for holding said inflatable tube means and said seat platform means when said inflatable tube means is deflated; and storage pack mounting means for detachably mounting said storage pack means to said inflatable tube means, said storage pack means and said storage pack mounting means being constructed and arranged whereby said storage pack means will be carried above the surface of said body of water.

2. The flotation system of claim 1 including stowage compartment means secured to said inflatable tube means in said bow portion, said stowage compartment means providing a stowage compartment deck spanning said bow portion at an elevation whereby when said inflatable tube means is inflated and said buoyant annular body is placed on said body of water said stowage compartment deck will be located above the surface of said body of water; said storage pack means being constructed and arranged with respect to said stowage compartment deck whereby said storage pack means will be located above said stowage compartment deck when said storage pack means is mounted to said buoyant annular body.

3. A flotation system for supporting a person on a body of water which comprises inflatable tube means providing a buoyant annular body when said inflatable tube means is inflated, said buoyant annular body having an inner wall and upper and lower surfaces and defining an a bottomless interior whereby when said buoyant annular body is placed on said body of water said lower surface will be submerged in said body of water and said inner wall will be partially submerged in said body of water with said bottomless interior being exposed to said body of water, said bottomless interior having a stern portion and a bow portion; seat platform means secured to said inflatable tube means across said buoyant annular body and at an elevation between said upper and lower surfaces whereby when said inflatable tube means is inflated and said buoyant annular body is placed on said body of water said seat platform will be located above the surface of said body of water, said seat platform means extending substantially completely across said buoyant annular body and so dividing said bottomless interior into said stern portion and said bow portion whereby a person sitting on said seat platform means may extend his feet and legs through said stern portion into said body of water and propel said flotation system by moving his lower legs and feet without sitting in said body of water; and stowage compartment means secured to said inflatable tube means across said bouyant annular body in said bow portion, said stowage compartment means providing a stowage compartment deck spanning said bow portion at an elevation whereby when said inflatable tube means is inflated and said buoyant annular body is placed on said body of water said stowage compartment deck will be located above the surface of said body of water.

4. The flotation system of claim 1 including oar mounting means secured to said inflatable tube means in near proximity to said seat platform means whereby a set of oars may be mounted by said oar mounting means and employed to propel said flotation system by a person sitting on said seat platform means.

5. The flotation system of claim 3 including oar mounting means secured to said inflatable tube means in near proximity to said seat platform means whereby a set of oars may be mounted by said oar mounting means and employed to propel said flotation system by a person sitting on said seat platform means.

6. The flotation system of claim 1 including wet well storage means mountable to said inflatable tube means in said stern portion; and wet well mounting means detachably mounting said wet well storage means in said stern portion at an elevation whereby when said inflatable tube means is inflated and said buoyant annular body is placed on said body of water said wet well being will be partially submerged in said body of water.

7. The flotation system of claim 3 including wet well storage means mountable to said inflatable tube means in said stern portion; and wet well mounting means detachably mounting said wet well storage means in said stern portion at an elevation whereby when said inflatable tube means is inflated and said buoyant annular body is placed on said body of water said wet well being will be partially submerged in said body of water.

8. The flotation system of claim 2 wherein said storage pack mounting means comprises dry duffel stowage compartment means mountable to said inflatable tube means in said bow portion, and dry duffel stowage compartment mounting means for detachably mounting said dry duffel stowage compartment means to said inflatable tube means whereby said dry duffel stowage compartment means will be supported by said stowage compartment deck; said dry duffel stowage compartment means detachably mounting said storage pack means whereby said storage pack means will be supported by said dry duffel stowage compartment means.

9. The flotation system of claim 8 including oar mounting means secured to said inflatable tube means in near proximity to said seat platform means whereby a set of oars may be mounted by said oar mounting means and employed to propel said flotation system by a person sitting on said seat platform means.

10. The flotation system of claim 1 including scuba tank mounting means comprising frame means configured to be supported by said upper surface of said buoyant annular body and to extend from one side of said buoyant annular body to the other side of said buoyant annular body, whereby said frame means spans said bow portion at about the same elevation as the elevation of said seat platform means; frame mounting means securing said frame means to said seat platform means; and scuba air tank carrying means mounting to said frame means above said upper surface of said buoyant annular body whereby at least one air tank may be carried by said frame means above said upper surface of said buoyant annular body.

11. The flotation system of claim 2 including scuba tank mounting means comprising frame means configured to be supported by said upper surface of said buoyant annular body and to extend from one side of said buoyant annular body to the other side of said buoyant annular body, whereby said frame means spans said bow portion at about the same elevation as the elevation of said seat platform means; frame mounting means securing said frame means to said seat platform means whereby said frame means is located between said stowage compartment deck and said storage pack means; and scuba air tank carrying means mounting to said frame means above said upper surface of said buoyant annular body whereby at least one air tank may be carried by said frame means above said upper surface of said buoyant annular body.

12. The flotation system of claim 3 including scuba tank mounting means comprising frame means configured to be supported by said upper surface of said buoyant annular body and to extend from one side of said buoyant annular body to the other side of said buoyant annular body, whereby said frame means spans said bow portion at about the same elevation as the elevation of said seat platform means and in near proximity to said stowage compartment deck; frame mounting means securing said frame means to said seat platform means whereby said stowage compartment means is accessible from above said frame means; and scuba air tank carrying means mounting to said frame means above said upper surface of said buoyant annular body whereby at least one air tank may be carried by said frame means above said upper surface of said buoyant annular body.

13. A flotation system for supporting a person on a body of water which comprises inflatable tube means providing a buoyant annular body when said inflatable tube means is inflated, said buoyant annular body having an inner wall and upper and lower surfaces and having a stern end and a bow end; seat platform means secured to said inflatable tube means across said buoyant annular body and at an elevation between said upper and lower surfaces whereby when said inflatable tube means is inflated and said buoyant annular body is placed on said body of water said seat platform will be located above the surface of said body of water; said annular body having a bottomless interior in at least a stern portion extending at least from said seat platform means to the stern end of said buoyant annular body whereby when said buoyant annular body is placed on said body of water said lower surface will be submerged in said body of water and said inner wall will be partially submerged in said body of water with said bottomless interior being exposed to said body of water, said seat platform means extending substantially completely across said buoyant annular body and so dividing said buoyant annular body into said stern portion and a bow portion whereby a person sitting on said seat platfrom means may extend his feet and legs through said stern portion into said body of water and propel said flotation system by moving his lower legs and feet without sitting in said body of water; and stowage compartment means secured to said inflatable tube means across said bouyant annular body in said bow portion, said stowage compartment means providing a stowage compartment deck spanning said bow portion.

14. The flotation system of claim 13 including storage pack means mountable in said bow portion, said storage pack means being of a size suitable for holding said inflatable tube means and said seat platform means when said inflatable tube means is deflated; and storage pack mounting means for detachably mounting said storage pack means to said inflatable tube means, said storage pack means and said storage pack mounting means being constructed and arranged whereby said storage pack means will be carried above the surface of said body of water, said storage pack means being constructed and arranged with respect to said stowage compartment deck whereby said storage pack means will be located above said stowage compartment deck when said storage pack means is mounted to said buoyant annular body.

15. The flotation system of claim 14 including oar mounting means secured to said inflatable tube means in near proximity to said seat platform means whereby a set of oars may be mounted by said oar mounting means and employed to propel said flotation system by a person sitting on said seat platform means.

16. The flotation system of claim 14 including wet well storage means mountable to said inflatable tube means in said stern portion; and wet well mounting means detachably mounting said wet well storage means in said stern portion at an elevation whereby when said inflatable tube means is inflated and said buoyant annular body is placed on said body of water said wet well being will be partially submerged in said body of water.

17. The flotation system of claim 14 wherein said storage pack mounting means comprises dry duffel stowage compartment means mountable to said inflatable tube means in said bow portion, and dry duffel stowage compartment mounting means for detachably mounting said dry duffel stowage compartment means to said inflatable tube means whereby said dry duffel stowage compartment means will be supported by said stowage compartment deck; said dry duffel stowage compartment means detachably mounting said storage pack means whereby said storage pack means will be supported by said dry duffel stowage compartment means.

18. A method of converting a flotation system into an integrated tote comprising the steps of:

a) providing a water vehicle that comprises inflatable tube means providing a buoyant annular body when said inflatable tube means is inflated, said buoyant annular body having an inner wall with upper and lower surfaces and defining a bottomless interior whereby when said buoyant annular body is placed on said body of water said lower surface will be submerged in said body of water and said inner wall will be partially submerged in said body of water with said bottomless interior being exposed to said body of water, said bottomless interior having a stern portion and a bow portion; seat platform means secured to said inflatable tube means across said buoyant annular body and at an elevation between said upper and lower surfaces whereby when said inflatable tube means is inflated and said buoyant annular body is placed on said body of water said seat platform will be located above the surface of said body of water, said seat platform means extending substantially completely across said buoyant annular body and so dividing said bottomless interior into said stern portion and said bow portion whereby a person sitting on said seat platform means may extend his feet and legs through said stern portion into said body of water and propel said flotation system by moving his lower legs and feet without sitting in said body of water; storage pack means mountable in said bow portion, said storage pack means being of a size suitable for holding said inflatable tube means and said seat platform means when said inflatable tube means is deflated; and storage pack mounting means for detachably mounting said storage pack means to said inflatable tube means, said storage pack means and said storage pack mounting means being constructed and arranged whereby said storage pack means will be carried above the surface of said body of water;

b) removing said storage pack means from said buoyant annular body and deflating said inflatable tube means;

c) folding the bow portion of the deflated tube means toward the stern portion and over the seat platform means; forming a transverse fold at the bow margin of the seat platform means; forming a longitudinal fold along both the port and starboard margins of the seat platform means, thus overlapping the margins of the lateral walls of the deflated tube means in registry to one another along a midship longitudinal line; and then completing the folding process by repeatedly folding over the seat platform means and reflecting and folding material toward the stern of the water vehicle until all material is tightly wrapped around the seat platform means; and d) stowing the folded water vehicle in said storage pack means.

19. A flotation system for supporting a person on a body of water which comprises inflatable tube means providing a buoyant annular body when said inflatable tube means is inflated, said buoyant annular body having an inner wall and upper and lower surfaces and having a stern end and a bow end; seat platform means secured to said inflatable tube means across said buoyant annular body and at an elevation between said upper and lower surfaces whereby when said inflatable tube means is inflated and said buoyant annular body is placed on said body of water said seat platform will be located above the surface of said body of water, said seat platform means extending substantially completely across said buoyant annular body and dividing said buoyant annular body into a stern portion and a bow portion; said annular body having a bottomless interior in at least said stern portion extending at least from said seat platform means to the stern end of said buoyant annular body whereby when said buoyant annular body is placed on said body of water said lower surface will be submerged in said body of water and said inner wall will be partially submerged in said body of water with said bottomless interior being exposed to said body of water, whereby a person sitting on said seat platform means may extend his feet and legs through said stern portion into said body of water and propel said flotation system by moving his lower legs and feet without sitting in said body of water; and storage pack means mountable in said bow portion, said storage pack means being of a size suitable for holding said inflatable tube means and said seat platform means when said inflatable tube means is deflated; and storage pack mounting means for detachably mounting said storage pack means to said inflatable tube means, said storage pack means and said storage pack mounting means being constructed and arranged whereby said storage pack means will be carried above the surface of said body of water.

20. The flotation system of claim 19 including oar mounting means secured to said inflatable tube means in near proximity to said seat platform means whereby a set of oars may be mounted by said oar mounting means and employed to propel said flotation system by a person sitting on said seat platform means.

21. The flotation system of claim 19 including wet well storage means mountable to said inflatable tube means in said stern portion; and wet well mounting means detachably mounting said wet well storage means in said stern portion at an elevation whereby when said inflatable tube means is inflated and said buoyant annular body is placed on said body of water said wet well being will be partially submerged in said body of water.

* * * * *